US005613797A

United States Patent [19]

Romagnolo et al.

[11] Patent Number: 5,613,797

[45] Date of Patent: Mar. 25, 1997

[54] ANHYDROUS VISCOELASTIC BUFFER JOINT

[75] Inventors: Mariano Romagnolo; Gabriele Camomilla, both of Rome, Italy

[73] Assignee: Autostrade - Consessioni E Costruzioni Autostrade S.p.A., Rome, Italy

[21] Appl. No.: 400,619

[22] Filed: Mar. 8, 1995

[30] Foreign Application Priority Data

Jun. 17, 1994 [IT] Italy ..... RM94A0387

[51] Int. Cl.[6] ..... E01D 19/08

[52] U.S. Cl. ..... 404/2; 404/47; 14/73.1

[58] Field of Search ..... 14/73, 73.1, 73.5, 14/74.5, 77.1; 404/47, 49, 67, 2, 3

[56] References Cited

U.S. PATENT DOCUMENTS

| | | | |
|---|---|---|---|
| 4,015,302 | 4/1977 | Clark | 404/47 X |
| 4,111,582 | 9/1978 | Tippett | 14/73.1 X |
| 4,914,884 | 4/1990 | Ohmatsu | 404/47 X |
| 4,925,339 | 5/1990 | Smith | 404/2 X |
| 5,125,763 | 6/1992 | Seantier | 14/73.1 X |

*Primary Examiner*—James A. Lisehora
*Attorney, Agent, or Firm*—McGlew and Tuttle

[57] ABSTRACT

An anhydrous viscoelastic buffer joint including a filling of viscoelastic bituminous material between the floor slab including the joint slit and the upper zone covered by the vehicles. The joint further includes drainage and canalization systems for the downflow of water in the zone of the joint.

8 Claims, 1 Drawing Sheet

ANHYDROUS VISCOELASTIC BUFFER JOINT

FIELD OF THE INVENTION

The present invention relates to an anhydrous viscoelastic buffer joint employed in the field of road construction works; more particularly it relates to a joint to be employed in the construction of bridges for constituting a continuous connection means for road traffic and a means for controlling the water flow at the site of the joint itself, so as to direct it towards water collecting and drainage ducts.

BACKGROUND OF THE INVENTION

In bridge constructions, at the site of a connection between constituent elements, there are provided connection means which have the task of forming superficial continuity elements for the girders between which they are interposed. This also ensures that the water coming from the surface and the paving does not come into contact with the structures making up the work. The detrimental effects produced by said water penetration are particularly harmful in presence of salts usually employed to defrost the road wearing course.

At the present state of the art, there are employed as continuity elements, certain viscoelastic samples made of a bituminous material, which are placed directly on the floor slab in presence of a simple waterproofing system realized through a sheath or a caulking with a superimposed sheet metal. This system being located centrally and including lateral drainage means usually in the form of tubes provided with microslots.

This construction permits in fact to obtain a good continuity as regards the comfort during passage of a motor vehicle on this road section, but often it doesn't insure waterproofing and the presence of the drainage means is not effective for collecting the water flow inside the buffer. The result is that the reinforced concrete structures and particularly the floor slab are frequently wetted with water which occasionally may be added with highly corrosive defrost salts, and this may have serious consequences on structural integrity of the girders and of the bridge itself.

SUMMARY AND OBJECTS OF THE INVENTION

An object of the present invention is that of providing a viscoelastic buffer joint which besides establishing a good continuity of the superficial butiminous wearing course, does not allow water flows to come into contact with the reinforced concrete making up the road work.

Another object of the present invention is that of providing a viscoelastic buffer joint whose laying is quickly obtained by means of usually employed constructive techniques, and which has an acceptable, i.e. limited cost, and allows an easy maintenance.

These and other aims of the present invention, which will be pointed out in the description, are attained by means of an anhydrous viscoelastic buffer joint which comprises a constituent filling means between the floor slab—including the joint slit—and the usual bituminous material corresponding to the wearing course, with recessed zones filled up with drainage bituminous conglomerate and separated from the viscoelastic bituminous material by a layer of modified bitumen. The recessed zones are obtained by realizing piers of fiber reinforced mortar, having an inclination opposite to the water flow towards the joint slit. These piers or blocks are covered by an elastic bituminous sheath. The recessed zones lead to flaring holes which are located on the lowest portions thereof, and are provided with geo-textile filters so as to prevent or delay the clogging of the drainage means of downflow tubes and collection channels.

BRIEF DESCRIPTION OF THE DRAWINGS

For the sole purpose of better explaining the present invention and without limiting thereby the field of possible applications and the field of possible variations of its basic configuration, in the following a description will be made of a preferred embodiment of the anhydrous viscoelastic buffer joint according to the invention; said configuration refers to FIG. 1 in which a transversal section of the joint itself is shown.

DETAILED DESCRIPTION OF THE PREFERRED EMBODIMENT

Figure 1:
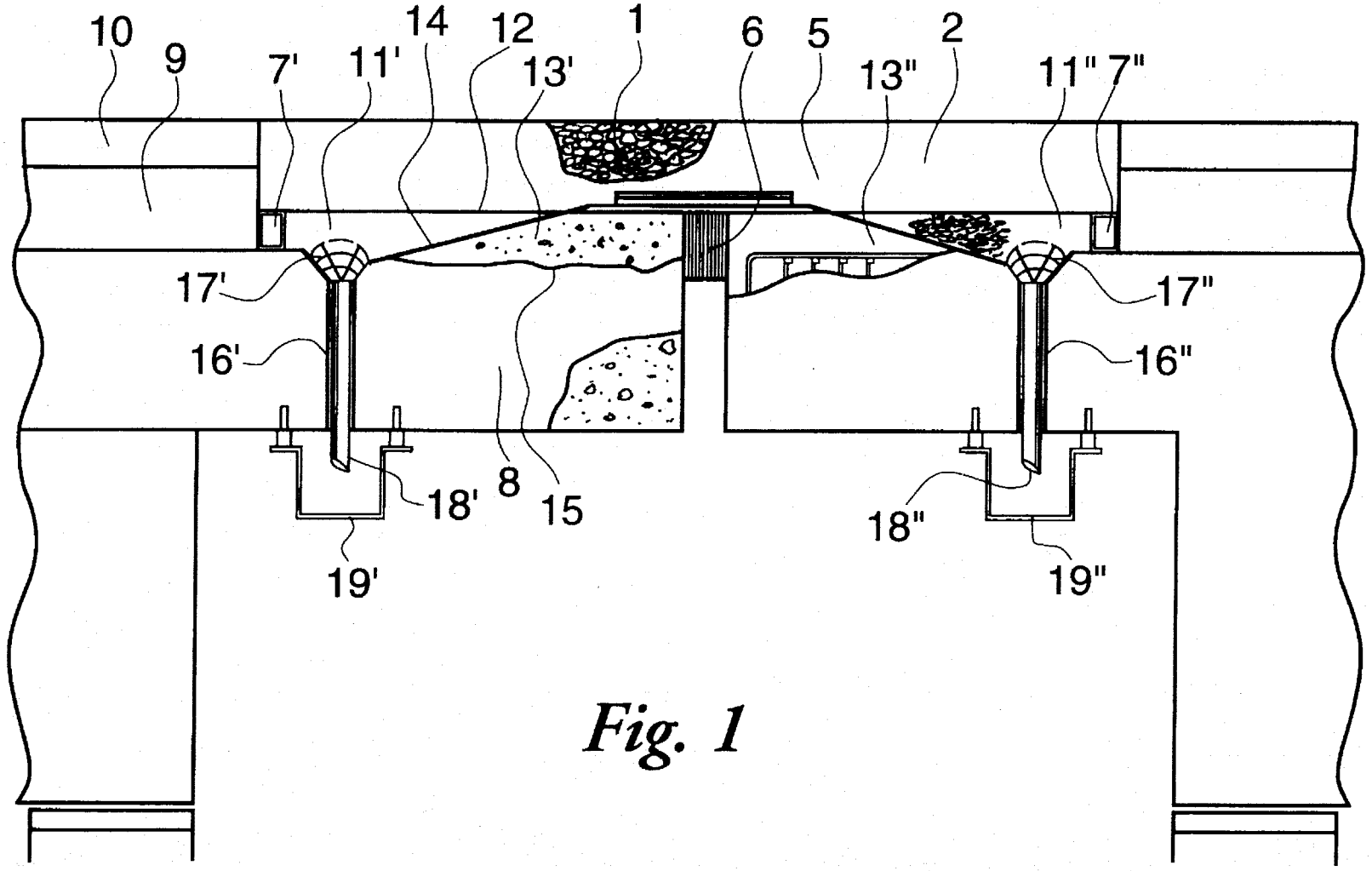

In the sectional view of FIG. 1, the viscoelastic material makes up the very buffer 2 which is usually formed by modified bitumen including various elastomers and polymer plastics mixed with aggregate to form a bituminous viscoelatic material. Bituminous viscoelastic material is a mixture of modified bitumen and aggregate.

Modified bitumen is bitumen of an elastomeric and/or polymer plastics kind and which change the properties of bitumen. There are also shown for clarity, the caulking 5, the sheet metal or reinforced bituminous sheath 6, and also the drainage element or means 7' and 7", already known at the present state of the art for forming the current buffer joints. The drawing puts into evidence fundamental constituent elements as for example the floor slab 8 and the binder layers 9 and wear layers 10 forming the bituminous wearing course. Bituminous wearing course is the usual coating of roads which is in direct contact with the wheels of the vehicles and which is conventional. Between the floorslab 8 and the viscoelastic bituminous material or buffer 2 there are interposed "recessed zones" 11' and 11" filled with bituminous drainage conglomerate and separated from the viscoelastic material of the buffer 2, by means of a layer 12 of modified bitumen. The recessed zones 11' and 11" being laid on end piers or blocks with opposite slanted surfaces 13', 13" formed by fiber reinforced mortar and covered by an elastic bituminous sheath 14, as for instance bituthene HD. An optimum waterproofing is obtained by a constructive tecnique which provides a rough surface 15 of the floor slab so that on said very rough surface, the fiber reinforced mortar of the piers 13', 13" having oppositely slanted surfaces, may generate higher frictional forces.

The recessed zones 11' and 11" lead to flaring holes or drainage paths 16' and 16" located at the lowest portions of the recessed zones. These flaring holes 16' and 16" direct the water collected by the geo-textile filters 17' and 17" of the drainage material, into the PVC downflow tubes 18', 18", and onto the PVC collection channels 19', 19".

This sort of conveying the water along specific tubes and channels 18', 18", 19', 19", is extremely advantageous with regard to waterproofing, since it drives the collected water away from the structures of reinforced concrete.

It must be reminded again, that this description is given only for a preferred configuration embodying the invention, which is illustrative and non-limitative, like the mentioned materials, which refer to the ensemble of construction materials most used nowadays in road works.

An anhydrous buffer joint of this kind has the advantage of being easy to realize by means of the usual techniques employed in the building industry, and further, it is quickly installed, so that it will have a reduced interference with traffic.

We claim:

1. An anhydrous viscoelastic buffer joint for roadways, the joint comprising:

a floor slab having an end and defining a drainage path spaced from said end;

a wearing course positioned on said floor slab, said wearing course being spaced from said end of said floor slab;

an end block positioned on said end of said floor slab, said end block having an inclined surface leading towards said drainage path to form a recessed zone;

a drainage conglomerate positioned adjacent said drainage path;

a viscoelastic bituminous material positioned on said end block and said drainage conglomerate.

2. A joint in accordance with claim 1, further comprising another floor slab having an end and defining another drainage path spaced from said end of said another floor slab, said end of said another floor slab cooperating with said end of said floor slab to form a joint;

another wearing course positioned on said another floor slab, said another wearing course being spaced from said end of said another floor slab;

another end block positioned on said end of said another floor slab, said another end block having an inclined surface leading towards said another drainage path to form another recessed zone;

another drainage conglomerate positioned adjacent said another drainage path;

said viscoelastic bituminous material also being positioned on said another end block and said another drainage conglomerate.

3. A joint in accordance with claim 2, further comprising:

caulking positioned between said ends of said floor slab and said another floor slab;

one of a metal sheet and a reinforced bituminous sheath positioned in said viscoelastic bituminous material, and positioned above the joint between said ends of said floor slab and said another floor slab.

4. A joint in accordance with claim 1, wherein:

said viscoelastic bituminous material replaces said wearing course as a wearing surface over said end block and said drainage conglomerate;

said drainage conglomerate is bituminous;

a layer of modified bitumen is positioned between said drainage conglomerate and said viscoelastic bituminous material;

said end block is formed by fiber reinforced mortar and covered with an elastic bituminous sheath;

said drainage path is a flared hole located at a bottom of said recessed zone;

a geo-textile filter is provided in said recessed zone for filtering said drainage conglomerate;

a collection channel is positioned on a side of said floor slab substantially opposite said drainage conglomerate;

a downflow tube is positioned extending from said flared hole to said collection channel.

5. A joint in accordance with claim 1, wherein:

said wearing course is spaced from said drainage path.

6. A joint in accordance with claim 1, wherein:

a height of said viscoelastic bituminous material above said floor slab is substantially equal to a height of said wearing course above said floor slab.

7. A joint in accordance with claim 1, further comprising:

a drainage element positioned between said viscoelastic bituminous material and said floor slab.

8. A joint in accordance with claim 1, wherein:

said end block has a thickness adjacent said end of said first floor slab, and said thickness decreases toward said drainage path.

* * * * *

UNITED STATES PATENT AND TRADEMARK OFFICE

CERTIFICATE OF CORRECTION

PATENT NO. : 5,613,797
DATED : March 25, 1997
INVENTOR(S) : ROMAGNOLO et al.

It is certified that error appears in the above-indentified patent and that said Letters Patent is hereby corrected as shown below:

On the title page, the Assignee data is as follows:

--[73] Assignee: Autostrade - Concessioni e Costruzioni Autostrade S.p.A., Rome, Italy

Signed and Sealed this

Thirteenth Day of January, 1998

*Attest:*

*Attesting Officer*

BRUCE LEHMAN

*Commissioner of Patents and Trademarks*